US008887978B2

(12) United States Patent
Chuba

(10) Patent No.: US 8,887,978 B2
(45) Date of Patent: Nov. 18, 2014

(54) PACKAGING MACHINE AND PROCESS

(75) Inventor: Larry Chuba, Akron, OH (US)

(73) Assignee: Automated Packaging Systems, Inc., Streetsboro, OH (US)

( * ) Notice: Subject to any disclaimer, the term of this patent is extended or adjusted under 35 U.S.C. 154(b) by 644 days.

(21) Appl. No.: 13/103,262

(22) Filed: May 9, 2011

(65) Prior Publication Data

US 2012/0214658 A1 Aug. 23, 2012

Related U.S. Application Data

(60) Provisional application No. 61/444,902, filed on Feb. 21, 2011.

(51) Int. Cl.

| | |
|---|---|
| ***B31B 1/26*** | (2006.01) |
| ***B65B 43/12*** | (2006.01) |
| ***B65B 43/26*** | (2006.01) |
| ***B65H 20/06*** | (2006.01) |
| ***B65B 61/12*** | (2006.01) |
| ***B65B 49/12*** | (2006.01) |
| ***B65B 49/16*** | (2006.01) |

(52) U.S. Cl.

CPC ..... *B31B 1/26* (2013.01); *B31B 2237/406* (2013.01); *B65B 61/12* (2013.01); *B31B 2219/022* (2013.01); *B31B 2237/10* (2013.01); *B65B 43/123* (2013.01); *B65B 43/267* (2013.01); *B65H 2701/191* (2013.01); *B31B 2219/9019* (2013.01); *B65H 20/06* (2013.01); *B65H 2301/44316* (2013.01); *B65B 49/12* (2013.01); *B65B 49/16* (2013.01)

USPC ..... 226/1; 226/172; 53/459; 53/570

(58) Field of Classification Search

CPC ..... B31B 1/10; B31B 1/26; B31B 2219/022; B31B 2237/10; B31B 2237/406; B65B 43/123; B65B 43/267; B65H 20/06; B65H 20/08; B65H 20/16; B65H 20/18; B65H 2301/44316; B65H 2701/191

USPC ..... 226/1, 4, 88, 109, 171, 172, 173; 53/459, 570, 468, 384.1, 389.4, 389.5

See application file for complete search history.

(56) References Cited

U.S. PATENT DOCUMENTS

| | | | | |
|---|---|---|---|---|
| 1,991,137 | A * | 2/1935 | Case | 271/205 |
| 2,899,201 | A * | 8/1959 | Pirot | 271/272 |
| 3,237,316 | A * | 3/1966 | Sachs | 34/115 |
| 3,254,828 | A | 6/1966 | Lerner | |
| 4,295,915 | A | 10/1981 | Sakaguchi et al. | |

(Continued)

OTHER PUBLICATIONS

International Search Report and Written Opinion from PCT/US11/35687 dated Aug. 9, 2011.

*Primary Examiner* — Sang Kim
*Assistant Examiner* — Scott Haugland
(74) *Attorney, Agent, or Firm* — Calfee, Halter & Griswold LLP

(57) ABSTRACT

A conveyor system pre-inserts a portion of the web into a first belt before the portion is gripped between the first belt and a second belt. In one exemplary embodiment, a pair of lips of a web are inserted into a corresponding first pair of belts and then the pair of lips are secured in the first pair of belts by inserting a second pair of belts into the first pair of belts over the pair of lips.

23 Claims, 16 Drawing Sheets

(56) References Cited

U.S. PATENT DOCUMENTS

| | | | | |
|---|---|---|---|---|
| 4,344,557 | A | 8/1982 | Lerner | |
| 4,514,962 | A | 5/1985 | Ausnit | |
| 5,517,737 | A * | 5/1996 | Viltro et al. | 26/88 |
| 5,722,218 | A | 3/1998 | Lerner | |
| 5,743,070 | A | 4/1998 | Lerner et al. | |
| 5,803,891 | A * | 9/1998 | Haan et al. | 493/442 |
| 5,957,824 | A | 9/1999 | Lerner et al. | |
| 6,170,238 | B1 | 1/2001 | Lerner | |
| 6,367,975 | B1 | 4/2002 | Cronauer et al. | |

* cited by examiner

PACKAGING MACHINE AND PROCESS

RELATED APPLICATIONS

The present application claims priority from application-Ser. No. 61/444,902, entitled "Packaging Machine and Process," filed on Feb. 21, 2011, the entire disclosure of which is incorporated herein by reference its entirety.

TECHNICAL FIELD

This invention relates a conveyor system for gripping and transporting a web, such as a plastic film and more particularly to a conveyor system that pre-inserts a portion of the web into a first belt before the portion is gripped between the first belt and a second belt.

BACKGROUND OF THE INVENTION

U.S. Pat. No. 5,743,070 (herein the S P Patent) entitled PACKAGING MACHINE, MATERIAL AND METHOD discloses a machine for use in packaging which has been highly successful commercially. The S P Patent and patents which resulted from divisional applications claim a machine and a plastic web used by that machine as well as a process of making packages.

With the machine of the S P Patent the web is fed first through a slitter which splits a top portion into two lips that are respectively grasped between associated pairs of belts for transport through a load section. The belts which transport the web through the load section are more fully described in U.S. Pat. No. 5,722,218 issued Mar. 3, 1998 and entitled PLASTIC TRANSPORT SYSTEM (herein the Load Belt Patent).

As the web is fed to the load section, the lips are spread to effect the sequential opening of the side connected bags, each into a rectangular opening for receiving a product to be packaged. The lips are then returned to juxtaposed relationship and trimmed as the lips are grasped by further belts in a sealer section. The further belts are preferably belts of the type described and claimed in U.S. Pat. No. 6,170,238 issued Jan. 9, 2001 and entitled SEALING MACHINE AND METHOD (herein the Sealer Belt Patent).

The S P, Load Belt and Sealer Belt Patents are incorporated herein by reference in their entireties.

SUMMARY

The present application relates to gripping and transporting a web, such as a plastic film. In one exemplary embodiment, a conveyor system pre-inserts a portion of the web into a first belt before the portion is gripped between the first belt and a second belt. In one exemplary embodiment, a pair of lips of a web are inserted into a corresponding first pair of belts and then the pair of lips are secured in the first pair of belts by inserting a second pair of belts into the first pair of belts over the pair of lips. This can be accomplished in a wide variety of different manners. In one exemplary embodiment, rollers are used. For example, a first roller or pair of rollers may press the pair of lips into grooves of the corresponding first pair of belts. A downstream second roller or pair of rollers then presses all or a portion of the second pair of belts into the grooves of the first pair of belts over the pair of lips to secure the pairs of lips between the corresponding pairs of belts. One type of packaging machine that may first insert a pair of lips into a first pair of belts and then secure the pair of lips by inserting a second pair of belts is a packaging machine that forms packages from a chain of side connected bags. However, many other types of packaging machines may benefit from first inserting a pair of lips into a first pair of belts and subsequently securing the pair of lips by inserting a second pair of belts.

DETAILED DESCRIPTION

I. Pre-Insertion of Web Into Transport Belts and Pre-Insertion Device

Figures 1, 1A:
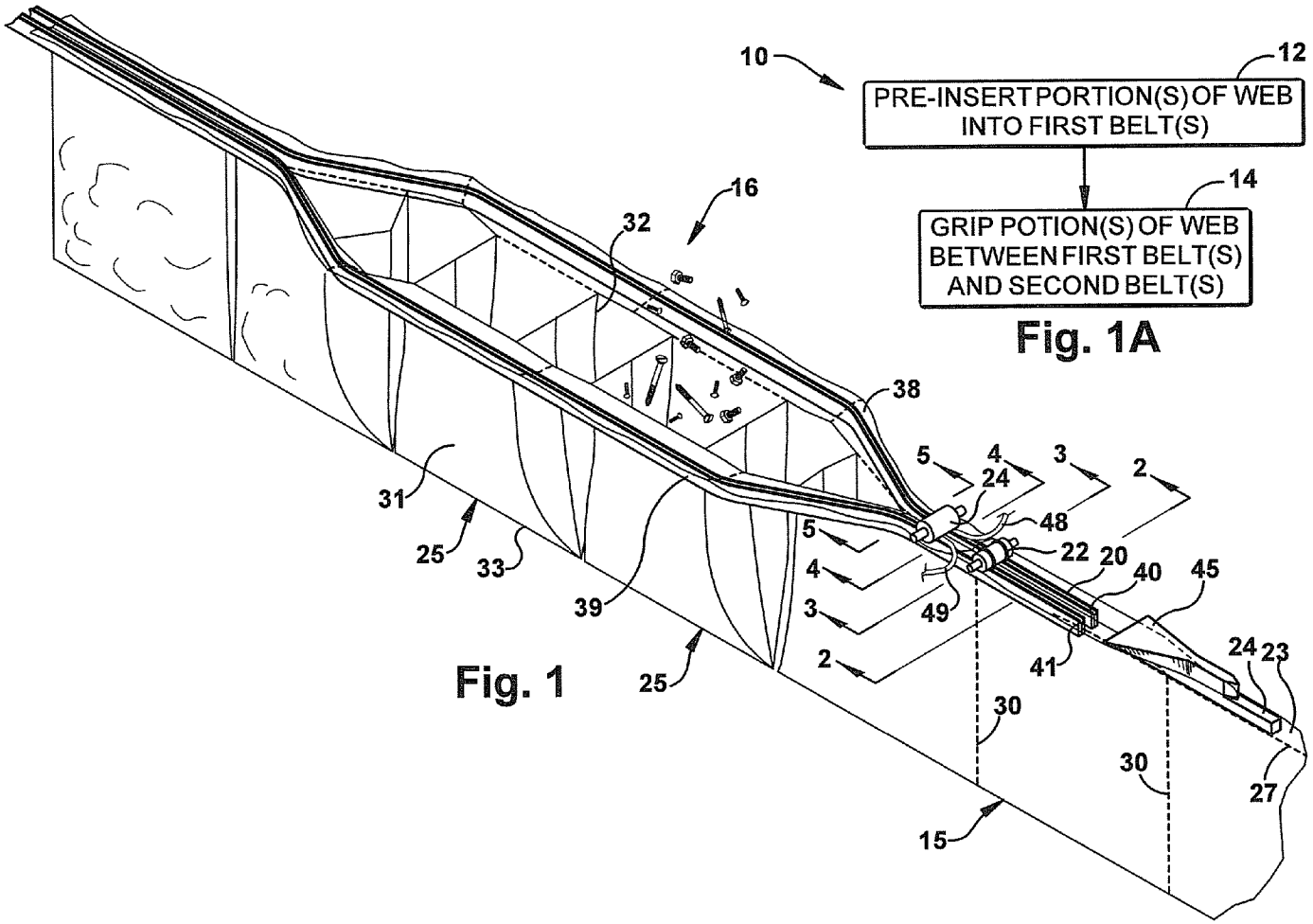
FIG. 1A is a flow chart that illustrates an exemplary embodiment of a method of gripping a web with one or more sets of conveyor belts.
FIG. 1 is a schematic perspective view of a web conveyor having a web gripping system.

The flow chart of FIG. 1A illustrates an exemplary embodiment of a method 10 of gripping a web 15 with belts 40, 41, 48, 49. In the method, a portion or portions of the web 15, such as lips 38, 39, are pre-inserted 12 into a first belt or pair of first belts 40, 41. Then, after the pre-insertion of the web portion or portions into the belt or pair of belts 40, 41, the web portion or portions are gripped 14 between the first belt or pair of belts 40, 41 and a second belt or pair of belts 48, 49. This may be accomplished in a variety of different ways by a variety of different apparatus. One layer of web material may be gripped or two lips may be gripped as shown in the following exemplary embodiment.

Figure 2:
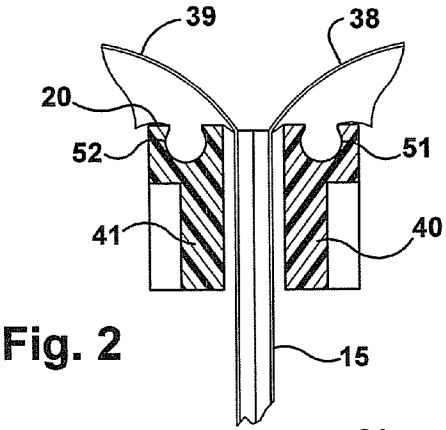
FIG. 2 is a sectional view taken along the plane indicated by lines 2-2 of FIG. 1.

FIGS. 1 and 2 illustrate an exemplary embodiment of a conveyor assembly 16 of an exemplary embodiment. The conveyor assembly 16 includes first endless conveyor belt(s) 40, 41 having a web engaging recess 51, 52 formed therein, second endless conveyor belt(s) 48, 49 having a cross-sectional configuration that mates with the recess 51, 52, a web pre-insertion device 22, and a belt insertion device 24. The web pre-insertion device 22 is positioned and configured to press a portion 38, 39 of the web 15 into the recess(es). The belt insertion device 24 is positioned to press the second endless conveyor belt 48, 49 into the recess 51, 52 after the pre-insertion device 22 has pressed the portion 38, 39 of the web into the recess. Pressing the second endless conveyor belt 48, 49 into the recess 51, 52 by the belt insertion device 24 causes the belts 40, 41, 48, 49 to grip the web. Movement of the belts 40, 41, 48, 49 moves the gripped web 15 along the path of travel.

The illustrated conveyor assembly 16 includes two pairs of belts 40, 41, 48, 49. However, other conveyors, for example conveyors that do not open the web with belts, may include only two belts, such as belts 40 and 48. The illustrated belts 40, 41 are endless conveyor belts (i.e. ends of the belt are connected to form a loop). The recess or groove 51, 52 of each belt 40, 41 can take a wide variety of different forms. In the illustrated embodiment, the recess or groove 51, 52 is circular in cross-section and is formed in a top surface 20 of each belt 40, 41. However, as will be described in more detail below, the recess or groove 51, 52 can be formed in other surfaces of the belts 40, 41 and can have different shapes. The illustrated belts 48, 49 are also endless and are circular in cross-section. However, the belts 48, 49 can have a variety of different shapes and configurations.

Figure 3:
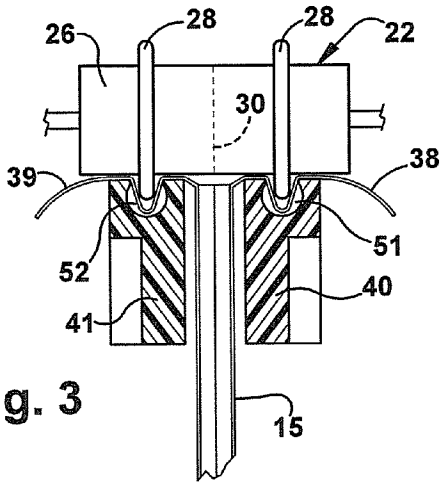
FIG. 3 is a sectional view taken along the plane indicated by lines 3-3 of FIG. 1.

The pre-insertion device 22 can take a wide variety of different foams. Examples of acceptable pre-insertion devices 22 include, but are not limited to rollers, fixed member that extends into the recess 51, 52, a moveable member with a portion that extends into the recess 51, 52, such as a tank tread or belt arrangement with a projection or projections that extend into the recess, an air nozzle, a vacuum applied between the recess and the web portion, etc. The pre-insertion device 22 may be any arrangement that moves the portion 38, 39 into the recess 51, 52 before the belt insertion device 24 presses the second endless conveyor belt 48, 49 into the recess 51, 52. In the example illustrated by FIGS. 1-5, the pre-insertion device 22 comprises a roller 26 (see FIG. 3) with annular projections 28 that fit in the recesses 51, 52. The dashed line 30 in FIG. 3 schematically indicates that the roller 26 may be a single roller that includes both projections or two separate rollers. The projections 28 may take a variety of different forms. In the illustrated embodiment, the projection 28 is annular.

The belt insertion device 24 can take a wide variety of different forms. Examples of acceptable belt insertion devices 24 include, but are not limited to rollers, a fixed member that pushes the second pair of belts 48, 49 into the recess 51, 52, a moveable member, such as a tank tread or belt arrangement, and including magnetic material in or on one or more of the belts 40, 41, 48, 49. The belt insertion device 24 may be any arrangement that moves the belts 48, 49 into the recess 51, 52 of the belts 40, 41. In the example illustrated by FIGS. 1-5, the belt insertion device 24 comprises a roller 32. The dashed line 34 in FIG. 4 schematically indicates that the roller 32 may be a single roller or two separate rollers.

Figure 5:
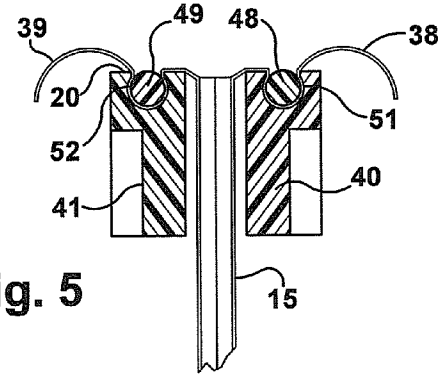
FIG. 5 is a sectional view taken along the plane indicated by lines 5-5 of FIG. 1.
Figure 4:
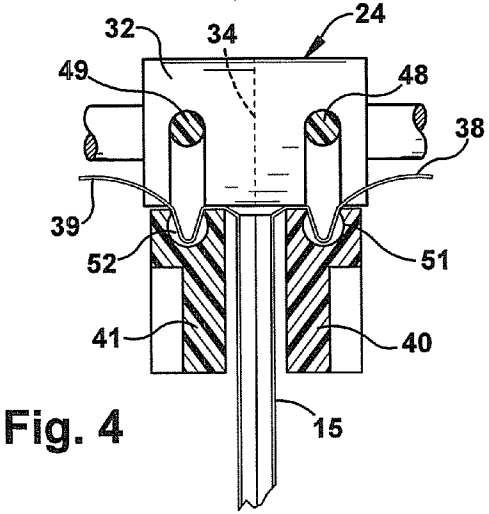
FIG. 4 is a sectional view taken along the plane indicated by lines 4-4 of FIG. 1.

The sectional views of FIGS. 2-5 at the positions indicated by FIG. 1 illustrate how the conveyor assembly 16 pre-inserts the lips 38, 39 of the the web 15 into the belts 40, 41 and then grips the lips between the belts 40, 41 and the belts 48, 49. Referring to FIGS. 1 and 2, at the position indicated by lines 2-2 in FIG. 1, the lips 38, 39 are positioned above the belts 40, 41. Referring to FIGS. 1 and 3, at the position indicated by lines 3-3 in FIG. 1, the lips 38, 39 are being pressed into the recesses 51, 52 by the projections 28 of the insertion roller 26. Referring to FIGS. 1 and 4, at the position indicated by lines 4-4 in FIG. 1, the lips 38, 39 are in the recesses 51, 52 of the belt and the belts 48, 49 are about to be pressed into the belts 40, 41 by the roller 32. Referring to FIGS. 1 and 5, at the position indicated by lines 5-5 in FIG. 1, the lips 38, 39 and the belts 48, 49 are in the recesses 51, 52 of the belt and the belts 48, 49 such that the lips 38, 39 are securely gripped between the belts 40, 41 and the belts 48, 49.

Referring to FIGS. 17-20, in one exemplary embodiment the web pre-insertion device 22 and the belt insertion device 24 are part of a single assembly 200. The assembly 200 can take a variety of different forms. The illustrated assembly includes a web pre-insertion roller 26, a belt insertion roller 32, and a mounting assembly 202. The mounting assembly 202 includes roller brackets 204 and mounting flanges 206. The web pre-insertion roller 26 and the belt insertion roller 32 are mounted between a pair of the roller brackets 204. Axles 208, 210 of the pre-insertion roller 26 and the belt insertion roller 32 are connected to the roller brackets 204. The axles 208, 210 may be within three inches of one another, within two inches of one another, or even within one inch of one another, so that the pre-insertion of the web 15 into the channels 51, 52 happens very close to the insertion of the belts 48, 49 into the channels. This may be the case regardless of whether or not the pre-insertion device 22 and the belt insertion device are part of the same assembly. The mounting flanges 206 are connected to the roller brackets 204 to facilitate attachment of the assembly 200 to the conveyor assembly 16. In the illustrated embodiment, the mounting flanges 206 include an adjustment mechanism 212 that allow the position of the roller brackets 204 to be adjusted with respect to the mounting flanges 206 in the direction indicated by arrow 220. This adjustment allows the position of the pre-insertion roller 26 and the belt insertion roller 32 to be adjusted relative to the belts 40, 41 to be adjusted, to adjust how far the web 15 is pressed into the recesses and/or how far the belts 48, 49 are pressed into the recesses 51, 52.

II. Packaging Machine that Uses the Pre-Insertion Device

Figure 6:
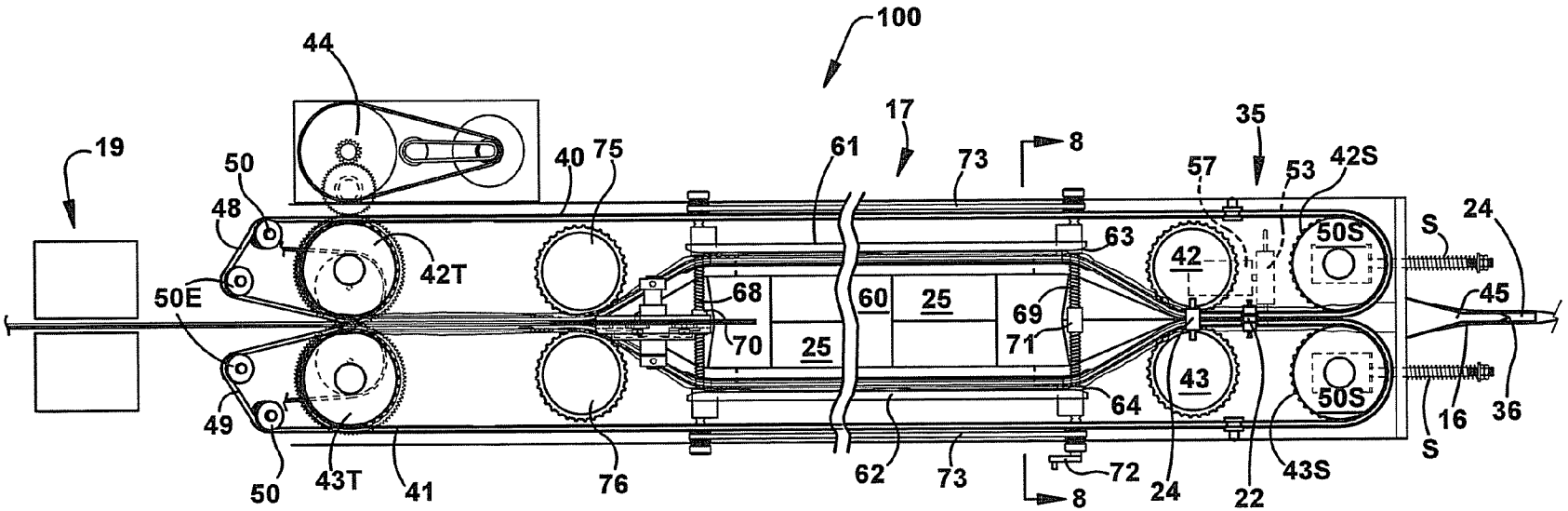
FIG. 6 is a top plan view of a bagger section of a machine utilizing an exemplary embodiment of a web gripping system.
Figure 7:
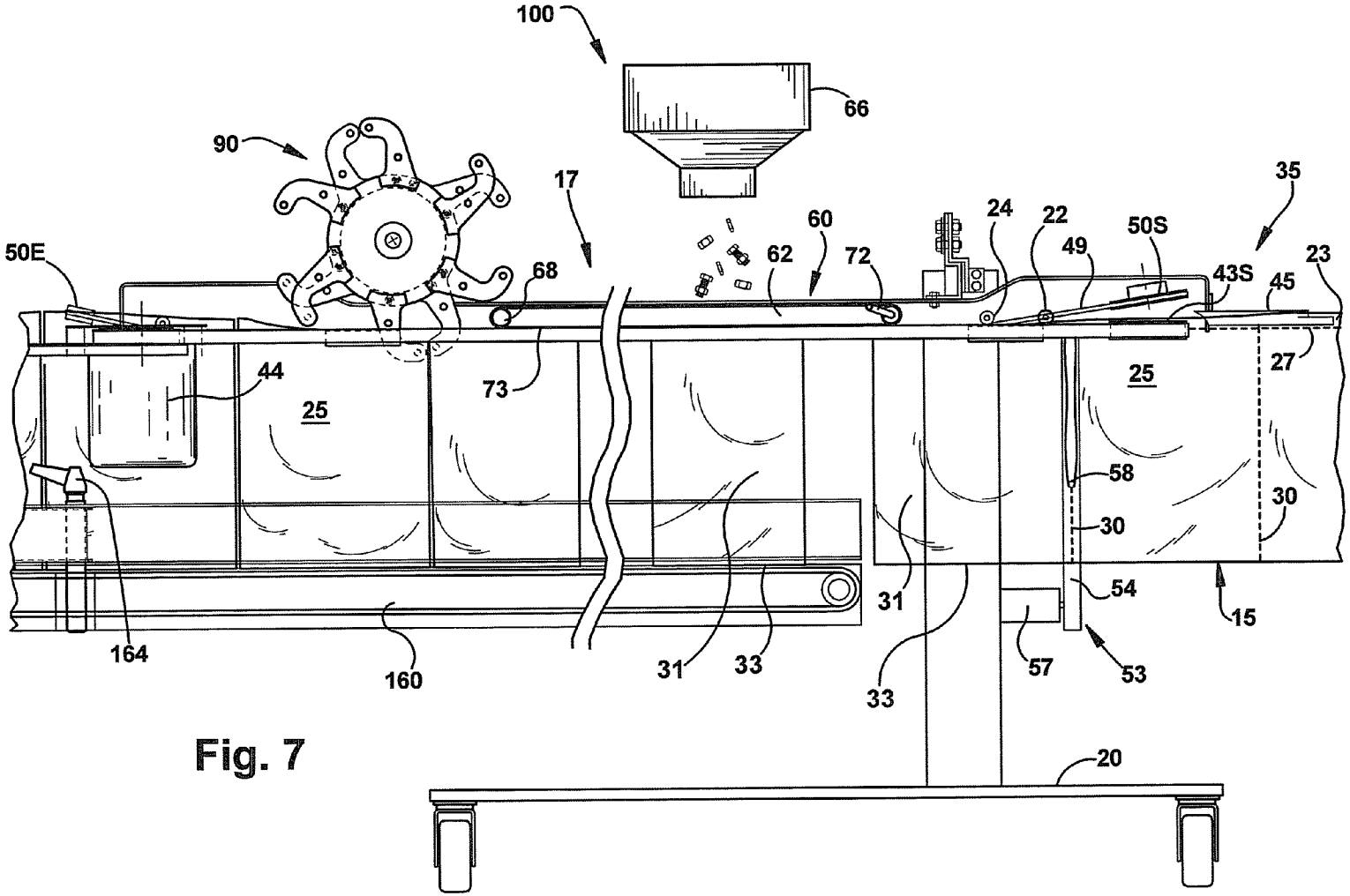
FIG. 7 is a side elevational view of the bagger section shown in FIG. 6.

The conveyor assembly 16 illustrated by FIGS. 1-5 can be used in a wide variety of different applications. For example, FIGS. 6 and 7 illustrate an exemplary embodiment of a bagging machine 100 that uses conveyor assembly 16 to make packages from a web 15 of side connected bags. The web 15 is fed from a supply shown schematically at 16 to a bagger section 17. The bagger section 17 is separably connected to an optional bag closure section schematically indicated at 19. The bag closure section can take a wide variety of different forms. For example, the bags may be sealed using the sealing machine and method disclosed by U.S. Pat. No. 6,170,238.

The bag closure section may be any apparatus that applies a closure (i.e. staple, tape, heat seal, re-sealable seal, etc.) to the loaded bags.

Referring to FIG. 7, the illustrated bagger section 17 includes an optional wheeled support carriage 20. The support carriage 20 includes a support frame for supporting bagging mechanisms. In the drawings the bagging mechanism is shown in its vertical orientation for gravity loading. The machine will be described in such orientation it being recognized that the mechanism may be positioned in a horizontal orientation and at other angular orientations.

III. Examples of a Web

The machines 100 with web pre-insertion arrangements may use or be adapted to use many types of packaging bags, which may include separate bags, as well as chains of connected bags. In one embodiment, the machine is adapted for use with a chain or web of side connected bags. In the exemplary embodiment, the web 15 is an elongated flattened plastic tube. The tube includes a top section 23 for feeding along a mandrel 24 (see FIGS. 1 and 7). The top section 23 may be connected to the tops of a chain of side connected bags 25 by front and back lines of weakness in the form of perforations 27. Frangible connections 30 connect adjacent bag side edges (see FIG. 7). Each bag 25 includes a face 31 and a back 32 interconnected at a bottom 33 by a selected one of a fold or a seal. Side seals adjacent the interconnections 30 delineate the sides of the bags 25. The bag faces and backs 31, 32 may be respectively connected to the top section 23 by the lines of weakness 27, 28, such that the top section 23 when the web is flattened itself is essentially a tube. Additional details of acceptable webs of preformed bags may be found in U.S. Pat. Nos. 3,254,828, 4,344,557, 5,957,824, and 6,367,975, all of which are incorporated herein by reference in their entirety.

The web 15 may be made from a wide variety of different materials. When the web is made from a relatively flexible material, such as a relatively thin layer of polyethylene, the web pre-insertion device 22 may be omitted. The web pre-insertion device 22 is particularly useful when the web is made from a thick material, a rigid material, or materials with a high coefficient of friction. In this application, a thick web material may be any material that is over 3.0 mils thick. The rigidity of a material is effected by thickness. In addition, some materials are more rigid than others. In this application, Polypropylene (PP), laminated structures, films containing high density polyethylene (HDPE), co-extruded materials containing barrier resins such as nylon (PA) and/or ethylene vinyl alcohol (EVOH) and materials having rigidity properties that are the same or similar to these materials are considered rigid materials. For the belts 48, 49 to be placed in the belts 40, 41, the web material must slide between the belts to some degree. If the material has a high coefficient of friction (i.e. the material is not "slippery" enough), the material may have difficulty sliding between the two belts when a belt 48, 49 is inserted into a belt 40, 41. In this application, a coefficient of friction greater than 0.15 is considered a high coefficient of friction.

The pre-insertion device 22 allows these materials to be gripped by the belts 40, 41 and 48, 49 by forcing the material into the recesses 51, 52, by getting the material in a shape that allows the belts 48, 49 to be inserted into the belts 48, 49 and/or by reducing the amount that the material has to stretch or slide to allow the belts 48, 49 to be inserted into the belts 40, 41. The pre-insertion device allows the belts 40, 41 and the belts 48, 49 to grip thick webs, rigid webs, and/or webs with a high coefficient of friction. An example of a material that the pre-insertion device 22 allows the belts 40, 41 and the belts 48, 49 to grip is OF3 mailbag material sold by Automated Packaging Systems, Inc. The pre-insertion device 22 allows the belts 40, 41 and the belts 48, 49 to grip webs that are made from a non-Linear Low Density Polyethylene (non-LLDPE) material, LLDPE webs having a thickness that is greater than 3.0 mils, and/or webs that have a coefficient of friction greater than 0.15.

IV. The Bagger Section 17

A. A Bag Feed and Preparation Portion 35

The web 15 is fed from the supply 16 into a bag feed and preparation portion 35 of the bagger section 17. The feed is over the mandrel 24 and past a slitter 36, FIG. 6. The slitter 36 separates the top section 23 into opposed face and back lips 38, 39. The feed through the bag feed and preparation portion 35 is caused by the pair of endless, oppositely rotating, main transport belts 40, 41 supported by oppositely rotating pulley sets 42, 43. The main belts 40, 41 are driven by a stepper motor 44, FIG. 6 through pulleys 42T, 43T of the sets 42, 43. Other of the pulleys 42S, 43S are spring biased by springs S, FIG. 6, to tension the belts.

Figure 9:
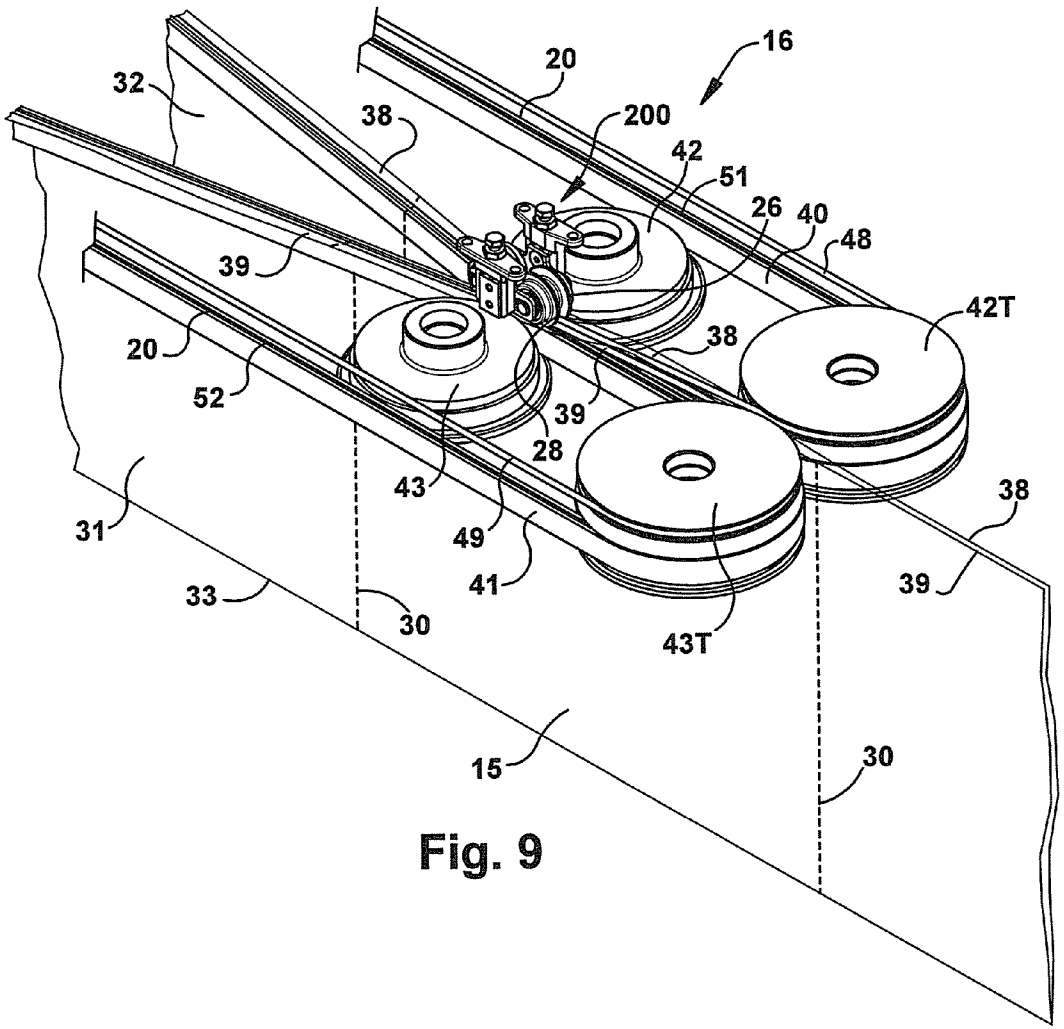
FIG. 9 is a partial perspective view of an exemplary embodiment of a web gripping system that may be included the machine illustrated by FIG. 6.
Figure 10:
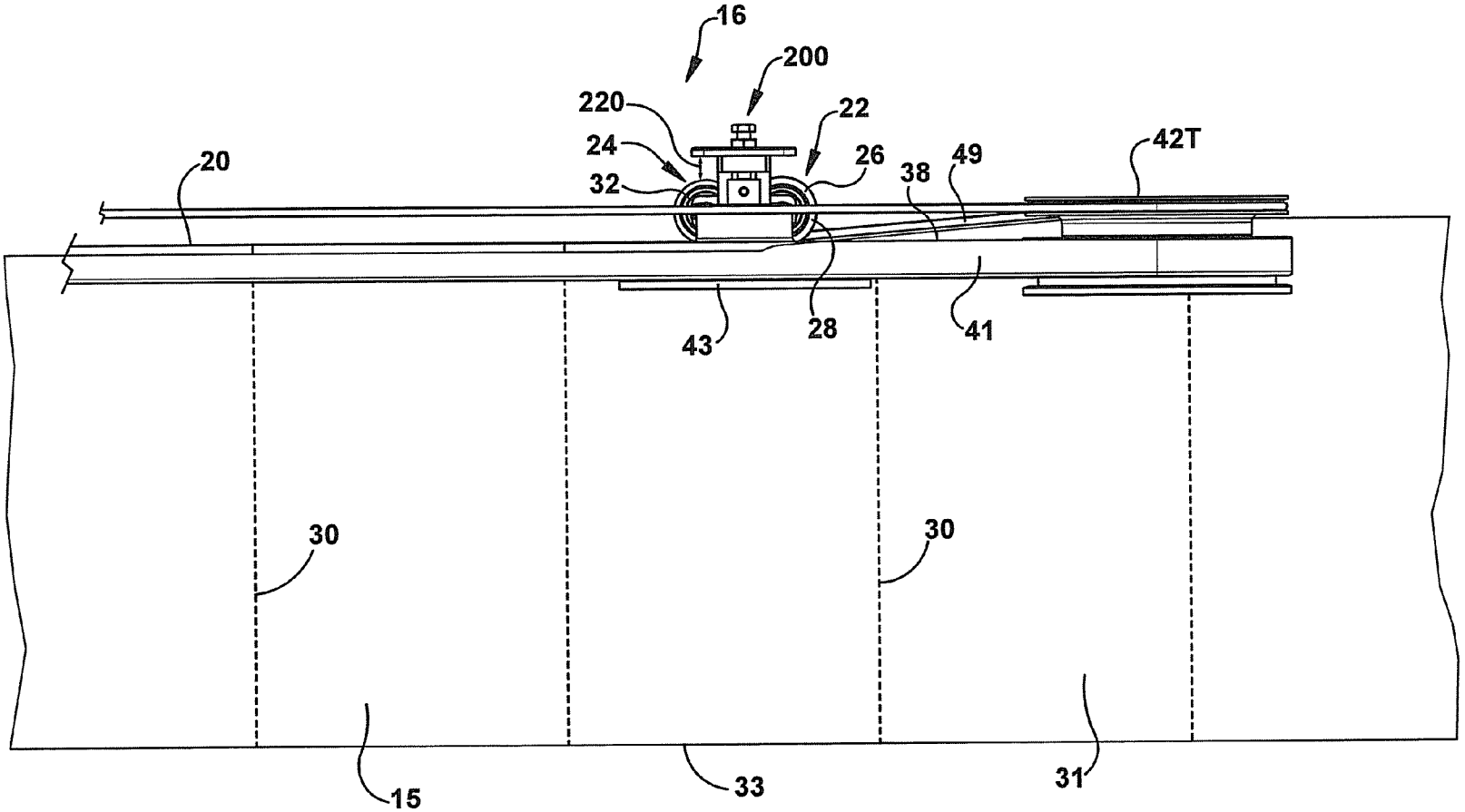
FIG. 10 is a side elevation view of the web gripping system illustrated by FIG. 9.
Figure 11:
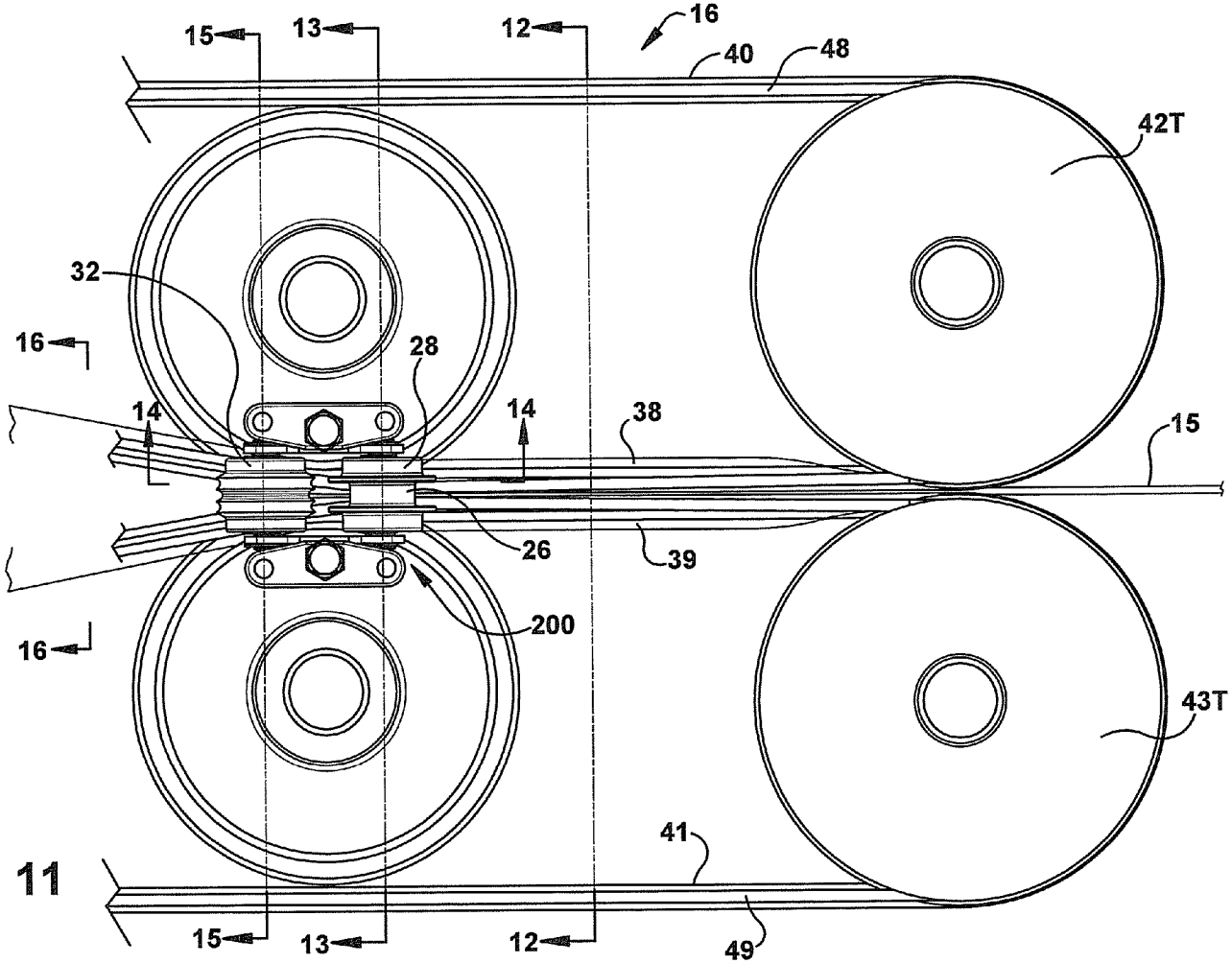
FIG. 11 is a top plan view of the web gripping system illustrated by FIG. 9.
Figure 12:
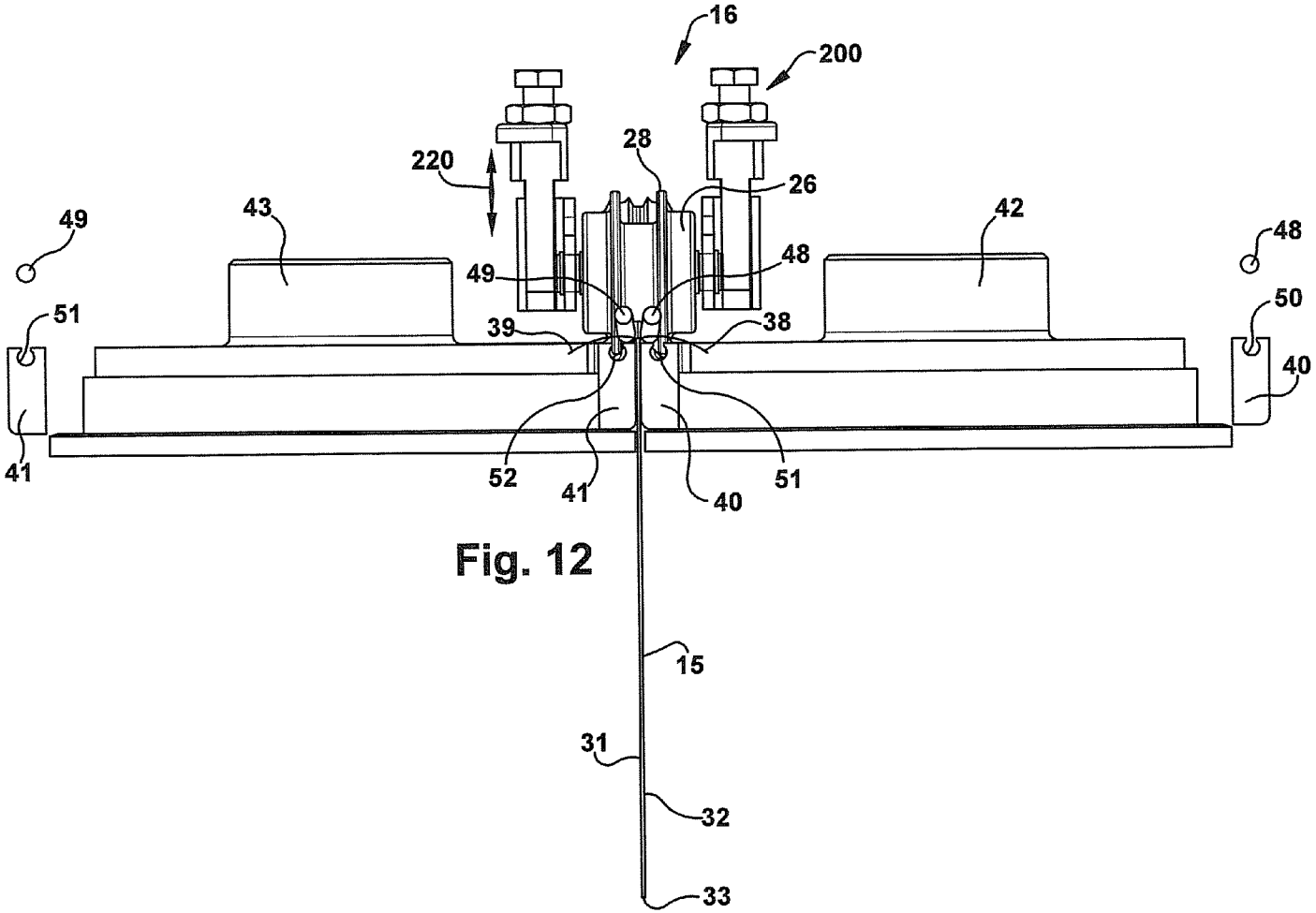
FIG. 12 is a sectional view taken along the plane indicated by lines 12-12 in FIG. 11.
Figure 13:
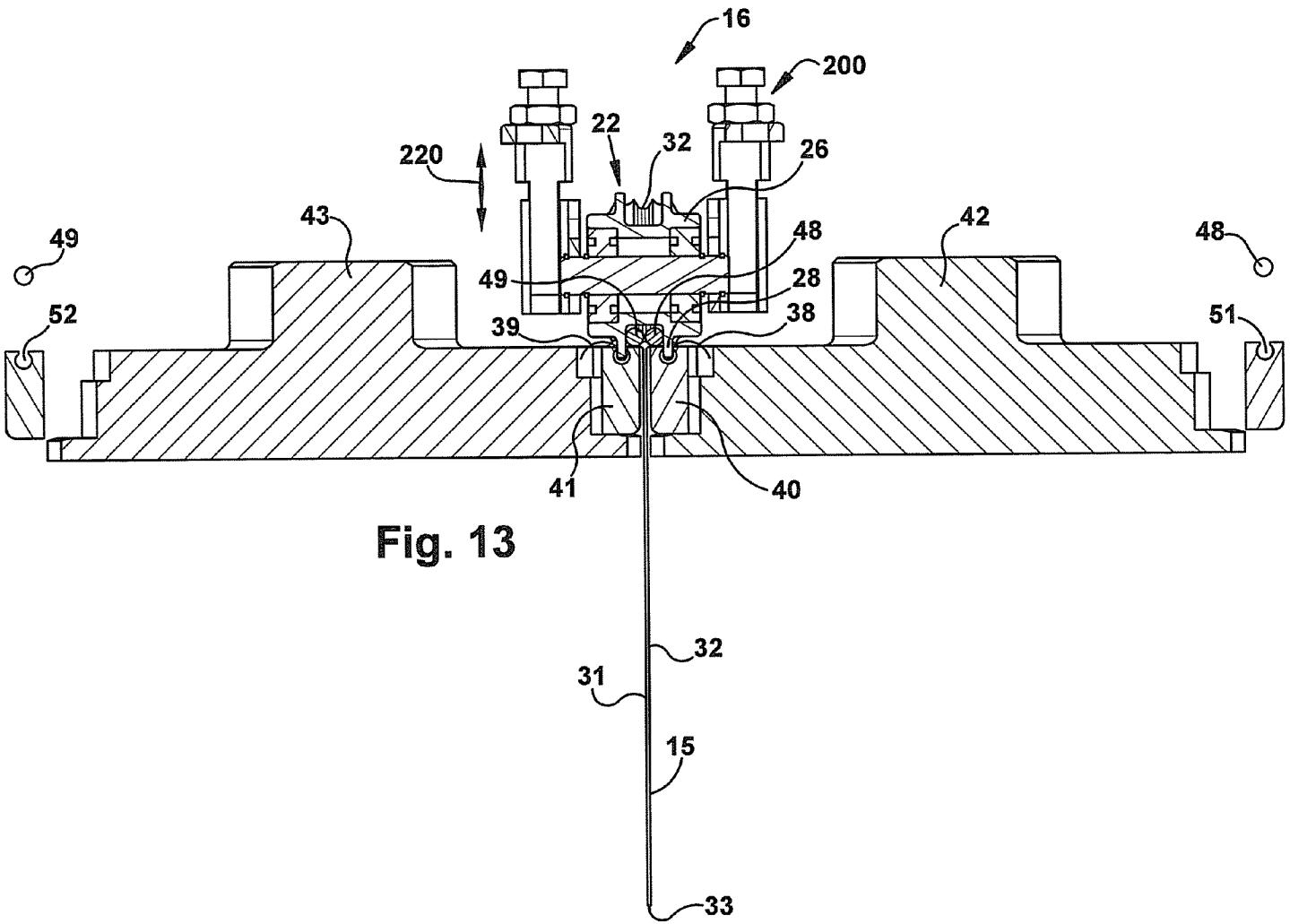
FIG. 13 is a sectional view taken along the plane indicated by lines 13-13 in FIG. 11.
Figure 14:
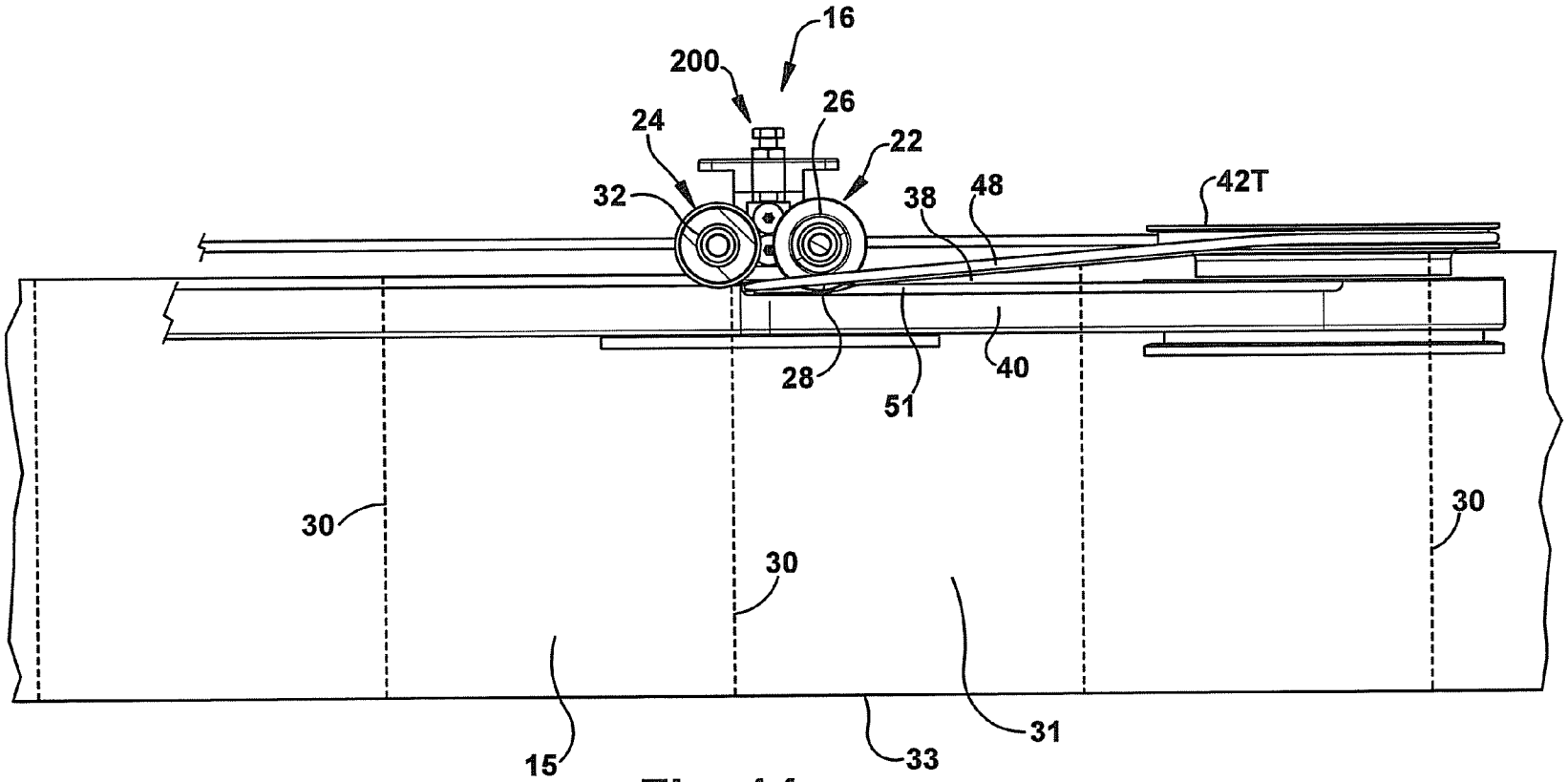
FIG. 14 is a sectional view taken along the plane indicated by lines 14-14 in FIG. 11.
Figure 15:
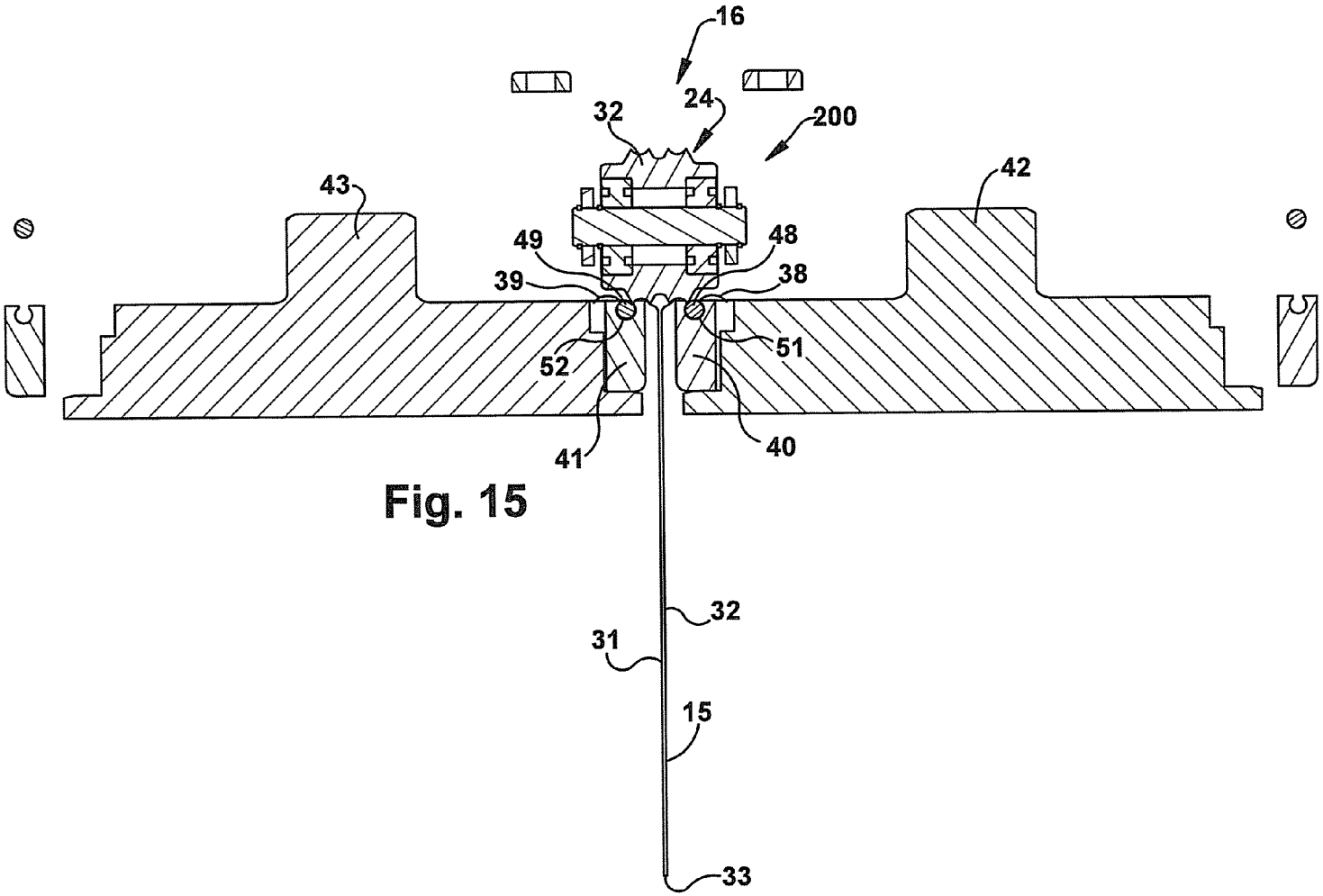
FIG. 15 is a sectional view taken along the plane indicated by lines 15-15 in FIG. 11.
Figure 16:
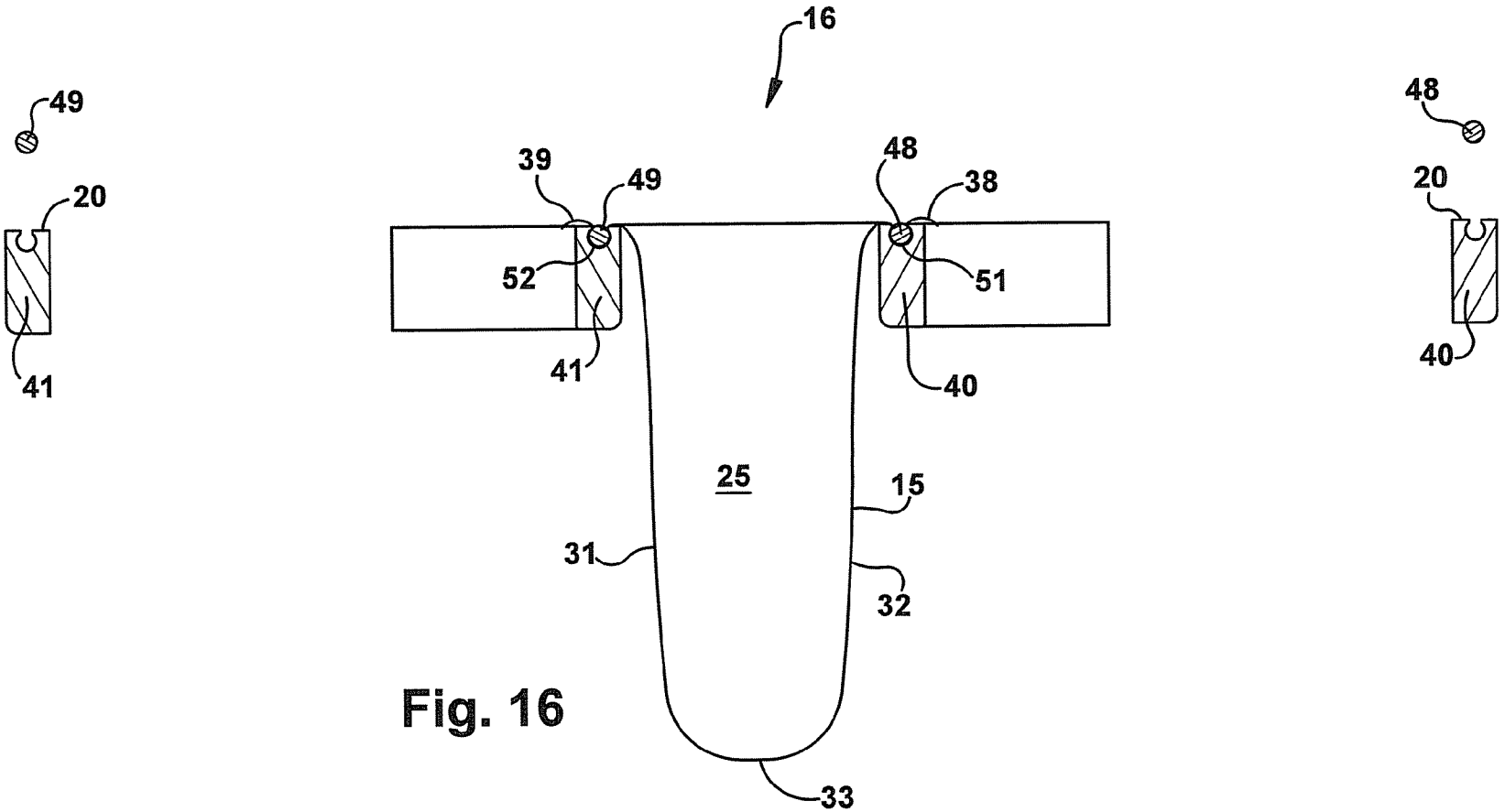
FIG. 16 is a sectional view taken along the plane indicated by lines 16-16 in FIG. 11.
Figure 18:
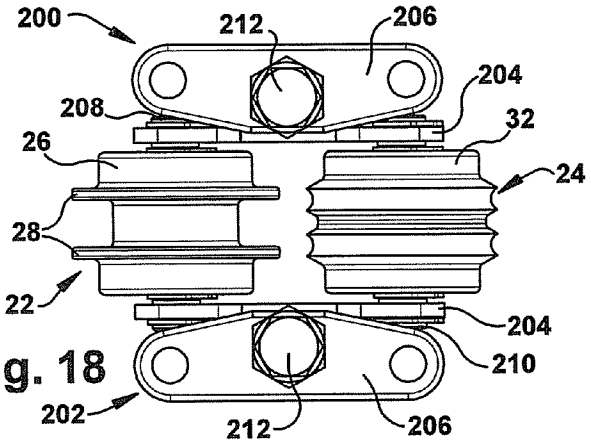
FIG. 18 is a top view of the roller assembly shown in FIG. 17.
Figure 20:
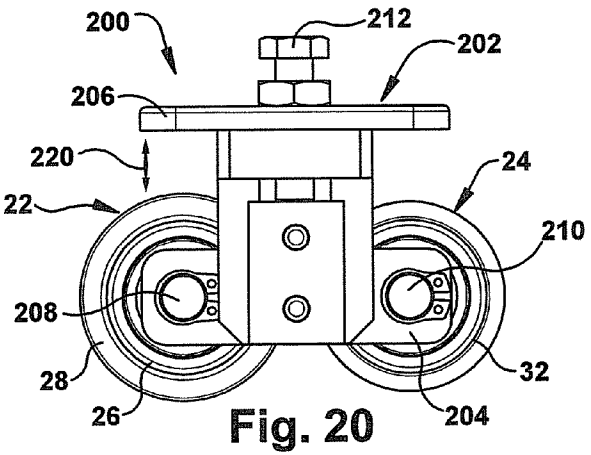
FIG. 20 is a side view of the roller assembly shown in FIG. 17.
Figure 17:
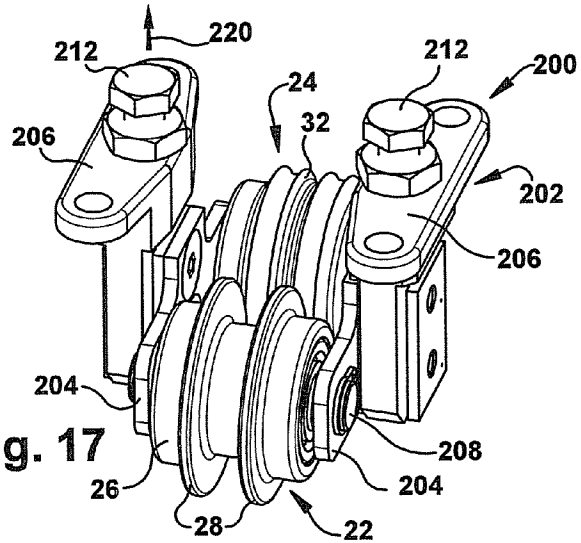
FIG. 17 is a perspective view of an exemplary embodiment of a roller assembly.
Figure 19:
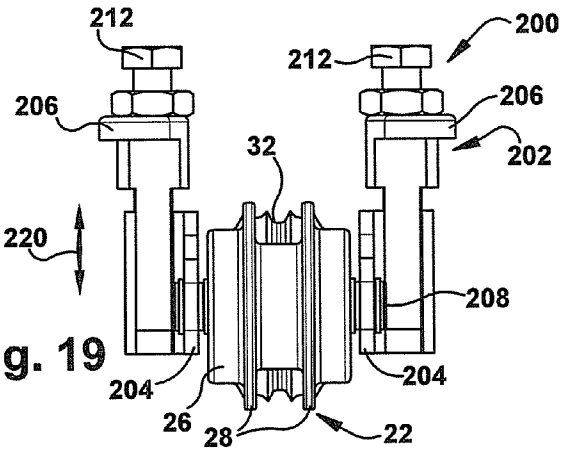
FIG. 19 is a front view of the roller assembly shown in FIG. 17.

Referring to FIGS. 6 and 7, a plow 45 is positioned a short distance upstream from the pre-insertion device 22 and the belt insertion device 24. roller cam 46. As the lips are drawn along by the main transport belts 40, 41, the lips 38, 39 are respectively folded over the top surfaces 20 of the belts 40, 41. As can be seen in FIGS. 7 and 9, the belts 48, 49 are above the belts 40, 41 in the area upstream of the pre-insertion device 22 and the lips 38, 39 are routed in the space between the belts 40, 41 and the belts 48,49. Once the web 15 reaches the pre-insertion device 22, the lips 38, 39 of the web pressed into the recess 51, 52 of the endless conveyor belts 40, 41 by the roller 26 at a position where the endless conveyor belts 48, 49 are still above the conveyor belts 40, 41 in a vertical direction. That is, the belts 48, 49 are on top or above the top surface 20 of the conveyor belts 40, 41 at the roller 26.

Once the lips 38, 39 are pre-inserted into the recesses 51, 52 of the belts 40, 41, the belt insertion device 24 presses the belts 48, 49 into the complemental grooves 51, 52 in belts 41, 42 respectively. In the embodiment illustrated by FIGS. 8 and 12-16, the belts 48, 49 are circular in cross section, while the grooves 51, 52 are segments of circles, slightly more than 180 degrees in extent. The camming of the belts 48, 49 into the grooves 51, 52 traps the lips 38, 39 between the belts 48, 49 and the grooves 51, 52. The lips 38, 39 are secured between the coacting belt pairs 40, 41 and 48, 49 such that the lips, due to their coaction with the belts, are capable of resisting substantial stuffing forces as products are forced into the bags at a load station 60. Sections of the belts 48, 49 which are not in the grooves 51, 52 are trained around a set of pulleys 50.

Referring to FIG. 7, an optional bag side separator mechanism 53 may be provided at a bag connection breaking station. The separator mechanism 53 includes an endless belt 54 which is driven by a motor 57. As the belt is driven, breaking pins 58 projecting from the belt 54 passes between adjacent sides of bags to break the frangible interconnections 30. Thus, as the bags depart the bag feed and preparation portion 35, they are separated from one another but remain connected to the lips 38, 39.

B. The Load Station 60

Figure 8:
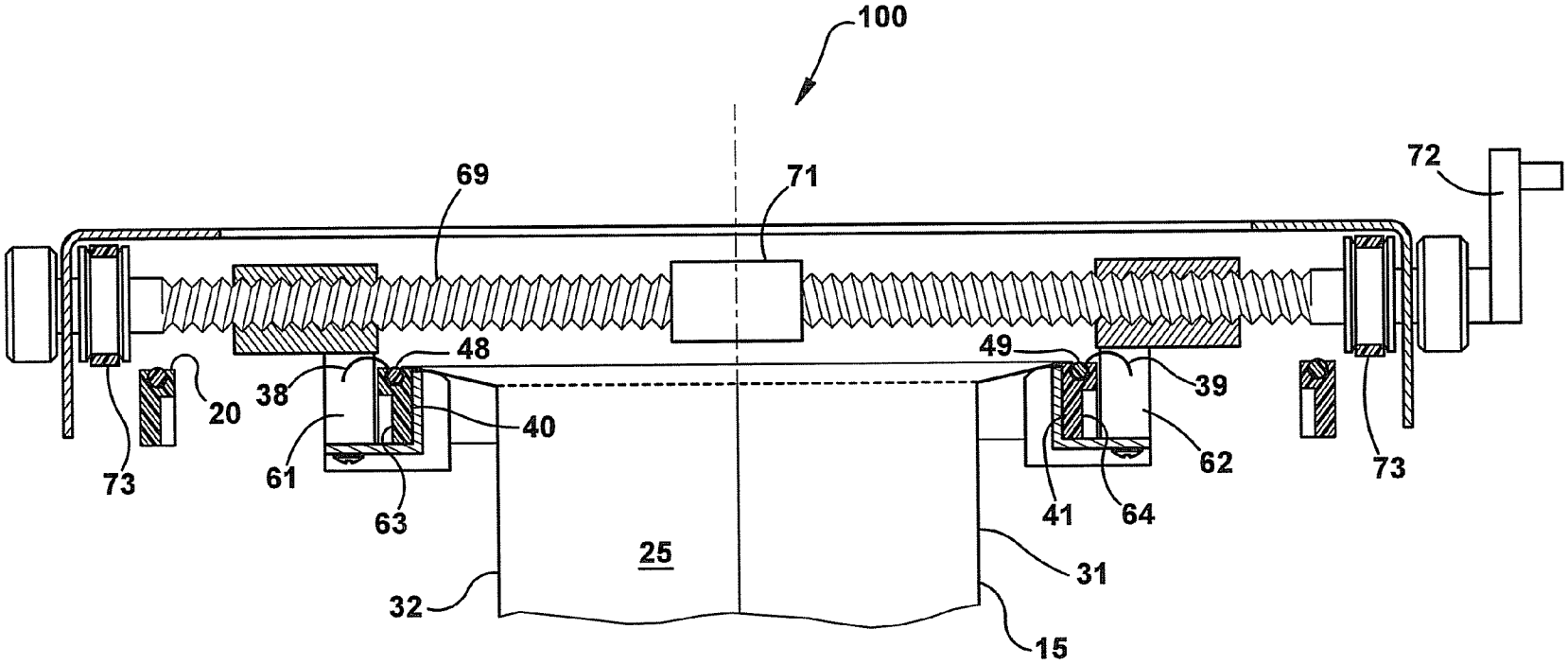
FIG. 8 is an enlarged, fragmentary, sectional view of the transport belt spacing adjustment mechanism as seen from the plane indicated by the lines 8-8 of FIG. 6.

Referring to FIGS. 6 and 8, the load station 60 includes a pair of parallel belt spreaders 61, 62. The belt spreaders are mirror images of one another. As is best seen in FIG. 6, the belt spreaders respectively include channels 63, 64. The channels 63, 64 respectively guide the main transport belts 40,41, on either side of the load station 60. When the transport belts 40,41, are in the channels 63, 64 (FIG. 8), the bags 25 are stretched between the belts in a rectangular top opening configuration (FIG. 6).

A schematic illustration of a supply funnel 66 is included in FIG. 7. It should be apparent that the products can be placed in the bags in a wide variety of different ways, which may be manual and/or automated. In the embodiment illustrated by FIG. 7, the products to be packaged may be deposited through the rectangular bag openings of the bags each time a bag is registered with the supply funnel at the load station.

Referring to FIGS. 6 and 8, a space adjusting mechanism may be provided for adjusting the width of the openings of the bags. This mechanism includes a spaced pair of adjustment screws 68, 69 (see FIG. 6). The adjustment screw 68, 69 are respectively centrally journaled by bearings 70, 71. The screws have oppositely threaded sections on either side of their bearings 70, 71 which threadably engage the belt spreaders 61, 62. Rotation of a crank 72 causes rotation of the adjustment screw 69. The screw 69 is connected to the screw 68 via belts or chains 73, which function to transmit rotation forces so that when the crank 72 is operated the screws 68, 69 are moved equally to drive the spreaders equally into an adjusted spatial, but still parallel, relationship.

As the spreaders are movably adjusted toward and away from one another, the spring biased pulleys 42S, 43S maintain tension on the belts 40, 41 while permitting relative movement of spans of the belts passing through the spreader channels 63, 64. The main transport pulley sets 42, 43 include two idler pulleys 75, 76 downstream from the load station 60. The idler pulleys 75, 76 are relatively closely spaced to return the belts 40, 41 into substantially juxtaposed relationship following exit from the load station 60.

Since the main and lip transport belts are relatively flexed in a vertical plane as they are brought together to grip a bag and relatively flexed in a horizontal plane as they pass through the load station, it will be seen that the belts are flexible in two directions which are orthogonal to one another.

C. Examples of Bag Stretching Arrangements

Figure 29:
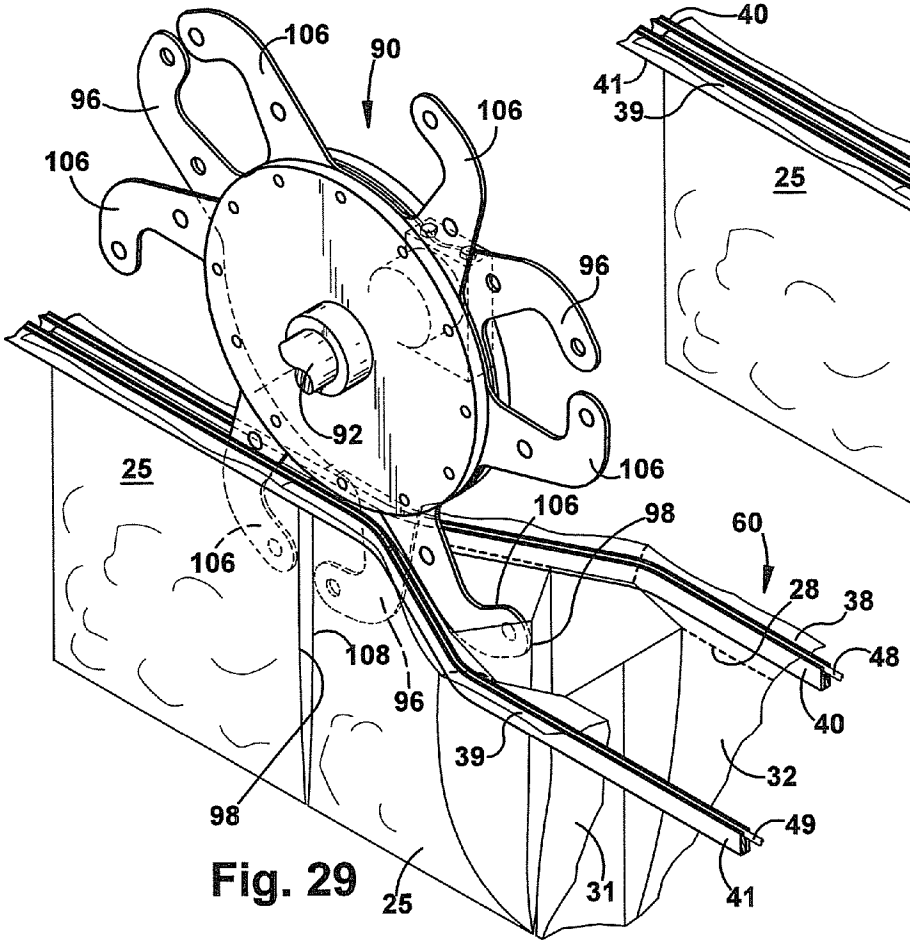
FIG. 29 is a perspective view of a portion of the bag flattening mechanism shown in FIG. 7.

As loaded bags exit the load station, it may be desirable to return upper portions of the bag faces and backs into juxtaposition. The machine of the present invention may employ many different mechanisms to stretch the bags such that the upper portions of the bag faces and backs are enabled to return to juxtaposition. One exemplary embodiment, used, for example, with smaller bags, includes a planetary stretcher 90 (FIG. 29).

The planetary stretcher may include a bag trailing edge engaging element that includes six bag engaging fingers 106. As is best seen in FIG. 29, one of those fingers 96 is shown in a lead one of the bags 25 while the next finger is being moved into the next bag in line as the next bag departs the load station 60. A lead edge engaging element has four fingers 96 which orbit at one and a half times the rate of the fingers 106. Rotation of the lead edge engaging element causes one of the fingers 96 to enter the next bag as it exits the load station and to engage a leading edge 108 of the bag while the trailing edge finger 106 engages the trailing edge 98, thereby stretching the bag until top portions of the bag face and back are brought into juxtaposition.

Figure 30:
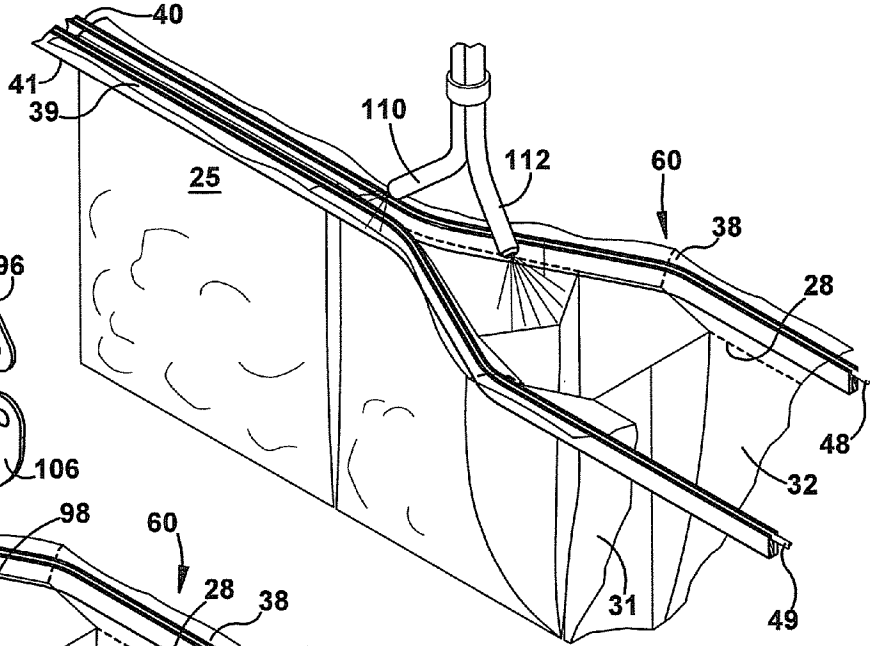
FIG. 30 is a perspective view showing an alternate arrangement to the mechanism of FIG. 7 for flattening bags

In another embodiment of the bag stretching device, illustrated in FIG. 30 and used, for example, with larger bags, the stretching of the loaded bags as they exit the load station may be accomplished with jets of air from nozzles, 112. The nozzles 110, 112 respectively blow air against the lead and trailing edges of the bag, thus stretching the bags from their rectangular orientation into a face to back juxtaposed relationship as the transport belts are returned to juxtaposition.

V. Example of a Closure Section/Closing Arrangement

The conveyor assembly 16 illustrated by FIGS. 1-5 can be used with a variety of different types of closing or sealing arrangements 19, including, for example, stapling, crimping, and heat sealing. Additionally many different mechanisms may be employed to hold the top portions of the bags together for sealing. Details of examples of acceptable closing arrangements can be found in the S P and Sealer Belt Patents referenced above.

VI. A Support Conveyor

In one exemplary embodiment, a support conveyor 160 may be provided to support the bottom of the bags 25 as they pass through the bagger section 17 (See FIG. 7). The support conveyor may include height adjustment and locking mechanisms 164 to locate the conveyor 160 in an appropriate position to support the weight of loaded bags being processed into packages.

V. The Alternate Belt Embodiments

The belts 40, 41 and the belts 48, 49 can take a wide variety of different forms. In some embodiments, only a portion of the belts 48, 49 may be accepted by the recesses 51, 52. In other embodiments, the recesses 51, 52 may be configured to accept more than one belt 48, 49. In other recesses, the recesses 51, 52 may not be provided in the top surfaces 20 of the belts 40, 41. FIGS. 21-28 illustrate a variety of different non-limiting examples of belt arrangements that may replace the belts 40, 41 and/or the belts 48, 49.

Figure 21:
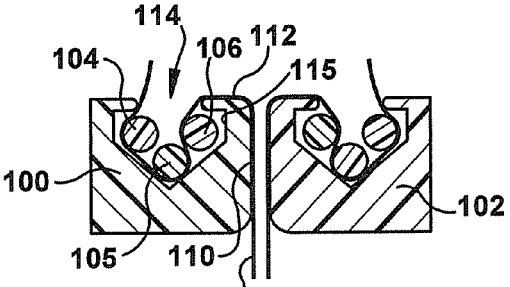
FIGS. 21-28 are sectional views of alternate belt embodiments of gripping belts each as seen from a plane normal to a path of travel of web supported by the belts.

Referring now to FIG. 21, mirror image main transport belts 100,102 are provided. Since the two are mirror images of one another, the transport belt 100 and the elements which co-act with it will be described, it being recognized that corresponding mirror image coaction is provided with the belt 102. In this embodiment three lip clamping belts 104-106 are provided. A section of the web 108 passes upwardly in engagement with a transport path side 110 of the main transport belt 100. The section 108 then passes across a top section 112 of the transport belt 100 and into a recess 114. The lip clamping belts 104-106 are disposed in the recess 114 which is in the shape of an arrowhead in cross section to accommodate the three belts. The web 108 is reeved over an inside surface of the damping belt 106 and thence under the transport belts 104,105. If downward force is applied to the fill 108, the film tends to push the clamping belt 106 into a corner 115 of the recess 114. The belts 104,105 are pulled together with the belt 105 clamping the film against the belt 106 to increase the gripping power of the arrangement as force is applied to the film 108.

Figure 22:
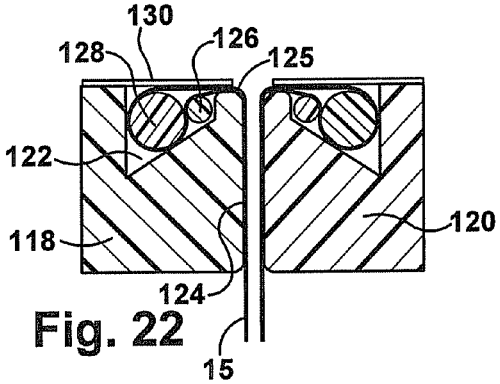

Referring now to FIG. 22, main transport belts 118,120 are disclosed. Again, in that the belts are mirror images, only the left hand belt will be described in detail. The belt 118 includes a generally triangular upper recess 122. The film section 108 extends upwardly along a side 124 of the belt 108, thence over a top surface 125 and into the recess 122. The film rides over a relatively small diameter clamping belt 126 and thence is reeved almost completely around a relatively large clamp belt 128. In this embodiment, the transport belt 118 rides under a rail 130 which retains the clamp belts 126,128 and the film in the recess 122. Downward forces on the film 108 pull the large clamp belt 128 against the rail and the small clamp belt 126 forcing the clamp belt 126 against a corner of the recess 122 and gripping the plastic firmly both between the clamp belts and between the clamp belt 128 and the rail 130.

Figure 23:
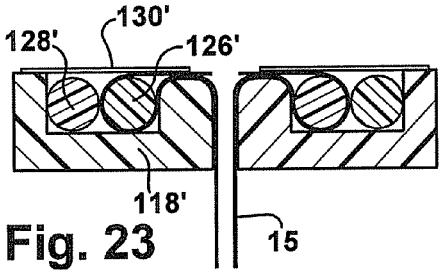

The embodiment of FIG. 23 is similar to FIG. 8, except that the recess is generally rectangular and the clamp belts are of equal size. Accordingly, like reference numerals with primes added are used in that embodiment.

Figure 24:
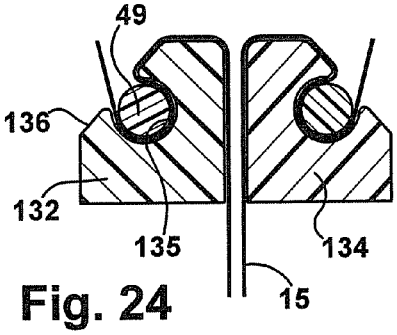

Referring now to FIG. 24, main transport belts 132,134 are provided. These belts are very similar to the preferred belts as shown in particular in FIGS. 5 and 6 with the exception that the clamp belt 49 resides in a recess 135 that is formed in a chamfered outwardly oriented surface 136, rather than a top surface as is the case with the surfaces 40S, 41S.

Figure 25:
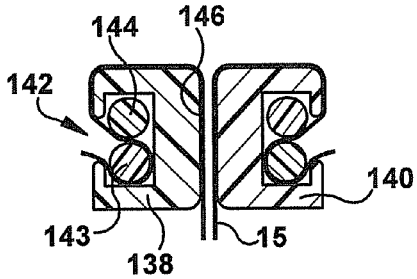

Referring now to FIG. 25, main transport belts 138,140 are provided. The transport belt 138 has an outwardly oriented recess 142 in which upper and lower clamp belts 144,145 are disposed. The film section 108 is trained upwardly along the inwardly facing side of the belt 138 over its top and thence downwardly and into the recess 142. The film is reeved substantially completely around the lower belt 145, such that when tension force is applied to the film 108 the belt 145 is pulled upwardly to increase the damping force between the clamping belts 144,145.

Figure 26:
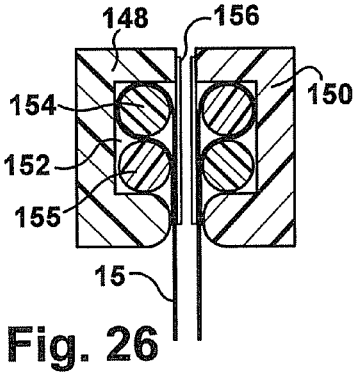

In FIG. 26, stationary rails 148,150 are provided. The rail 148 has in inwardly oriented rectangular recess 152. A pair of equally sized circular clamping belts 154,155 are disposed within the recess 152. The film section 108 is reeved substantially completely around the upper one of the clamping belts 154 and over the lower clamping belt 155, such that downward force on the film 108 will increase friction around a majority of the perimeter of the upper belt 154 and tightly clamp the film between the clamping belts 154,155. Another fixed rail 156 co-acts with the belts 154,155 to maintain them in the recess 152.

Figure 27:
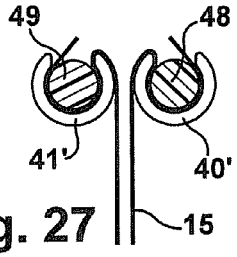

FIG. 27 differs from the embodiment of FIGS. 2-5 only in that the external surfaces of the transport belts are circular and thus the belts are identified by their reference numerals 40', 41'.

Figure 28:
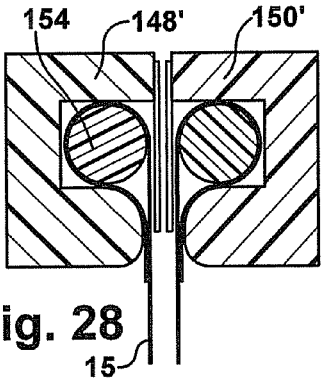

FIG. 28 is a variant of the embodiment of FIG. 26, in which the lower clamping belt 155 has been omitted and stationary rails are identified by the reference numerals 148',150'. These examples illustrate that the belts 40, 41 and the belts 48, 49 can take a wide variety of different forms, with the pre-insertion device 22 and the belt insertion device 24 being adapted to work with the different belt configurations.

VI. Operation of the Machine

A web 15 of bags 25 is fed through the bagger by jogging. The transverse spacing of the main conveyor belts 40, 41 is adjusted by rotating the crank 72 until the load station 60 has the desired transverse dimension. A control, not shown, is set to provide a desired feed rate and a selected one of continuous or intermittent operation.

Once the machine is in operation, the top section 23 of the web 15 is fed along the mandrel 24 and slit by the slitter 36. This forms the lips 38, 39 which are folded over the main transport belts 40, 41 by the action of the plow 45. The belts 48, 49 descend from the elevated and spring biased pulleys 50S, as shown in FIGS. 7 and 9. The pre-insertion device 22 presses the lips 38, 39 into the recesses and then the belt insertion device 22 pushes the belts 48, 49 into the recesses 51, 52 to provide very positive and firm support for the bags as they are further processed. As successive side connections 30 of the bags are registered with the bag side separator 53, the motor 55 is operated to drive the belt 54 and cause the breaker pins 58 to rupture the side connections 30.

As adjacent runs of the belts 40, 41 progress downstream from the bag feed and preparation portion 35, the belts are spread under the action of the belt spreaders 61, 62. As the belts are spread, the lips 38, 39 cause the front and back faces 31, 32 adjacent the lead edge of each bag to separate from the lips 38, 39 by tearing a sufficient length of the perforations between them to allow the lead edge to become the midpoint in a bag span between the belts as the bag passes longitudinally through the load station 60. Similarly, the perforations adjacent the trailing edge are torn as the trailing part of the bag is spread until the bag achieves a full rectangular opening as shown in FIG. 6.

Next a product is inserted into the rectangular bag as indicated schematically in FIG. 6. While the schematic showing is of discrete fasteners, it should be recognized that this machine and system are well suited to packaging liquids and bulky products which must be stuffed into a bag, such as pantyhose and rectangular items, such as household sponges.

After the product has been inserted, the adjacent runs of the main transport belts are brought back together and the loaded bag tops are spread longitudinally of the path of travel either by the planetary stretcher 90 (FIG. 29) or by opposed air streams from nozzles (FIG. 30).

As is best seen in FIG. 7, exit ones 50E of the lip belt pulley set are spaced from the main transport belt and rotatable about angular axes. Expressed more accurately, when the machine is in a vertical loading orientation, the pulleys 50E are above the main transport belt such that the belts 48, 49 are pulled from the grooves 51, 52.

Although the invention has been described in its preferred form with a certain degree of particularity, it is understood that the present disclosure of the preferred form has been made only by way of example and that numerous changes in the details of construction, operation and the combination and arrangement of parts may be resorted to without departing from the spirit and the scope of the invention as hereinafter claimed.

I claim:

1. A conveyor assembly for gripping a web material and moving the web material along a path of travel comprising:

a first endless conveyor belt having an endless web engaging recess formed therein;

a second endless conveyor belt, the recess and the second belt having mating cross sectional configurations;

a web pre-insertion device positioned to directly contact and press a portion of the web into said recess upstream of any contact between the second conveyor belt and the web; and a belt insertion device positioned to press the second endless conveyor belt both into contact with said portion of the web and into the recess downstream from where the pre-insertion device has pressed said portion of the web into the recess, wherein pressing the second endless conveyor belt into the recess by the belt insertion device causes the first and second belts to grip the web, wherein movement of the first and second endless belts moves the gripped web along the path of travel.

2. The conveyor assembly of claim 1 further comprising a drive for moving the first and second belts to transport the web along the path of travel.

3. The conveyor assembly of claim 1 wherein the web pre-insertion device is a roller.

4. The conveyor assembly of claim 3 wherein the roller includes an annular projection that fits in the recess of the first endless conveyor belt.

5. The conveyor assembly of claim 4 wherein the annular projection presses the web into the recess of the first endless conveyor belt.

6. The conveyor assembly of claim 1 wherein the belt insertion device is a roller.

7. The conveyor assembly of claim 1 wherein the web pre-insertion device is a first roller and the belt insertion device is a second roller.

8. The conveyor assembly of claim 7 wherein an edge of said web is routed between the first endless conveyor belt and the second endless conveyor belt at a position where the first and second endless conveyor belts are spaced apart in a vertical direction, and wherein said edge of said web is pressed into the recess of the first endless conveyor belt by the first roller at a position where the second endless conveyor belt is on or above a top surface of the first conveyor belt.

9. The conveyor assembly of claim 7 wherein an edge of said web is routed between the first endless conveyor belt and the second endless conveyor belt at a position where the first and second endless conveyor belts are spaced apart in a vertical direction, then said edge of said web is pressed into the recess of the first endless conveyor belt by the first roller at a position where the first and second endless conveyor belts are spaced apart in a vertical direction.

10. The conveyor assembly of claim 7 wherein the first roller and the second roller are within three inches of one another along said path of travel.

11. A conveyor assembly for gripping first and second lips of a web material and moving the web material along a path of travel comprising:

a first pair of endless conveyor belts each having an endless web engaging recess formed therein;

a second pair of endless conveyor belts, the web engaging recess of each first belt and each second belt having mating cross sectional configurations;

a web pre-insertion device positioned to directly contact and press first and second lip portions of the web into said recesses such that one lip portion is pressed into each recess upstream of any contact between said second pair of endless conveyor belts and the web; and a belt insertion device positioned to press the second pair of endless conveyor belts both into contact with the first and second lip portions and into the recesses downstream from where the pre-insertion device has pressed said first and second lip portions of the web into the recesses, wherein pressing the second pair of endless conveyor belts into the recesses by the belt insertion device causes the first and second pairs of belts to grip the first and second lip portions of the web respectively, wherein movement of the first and second endless belts moves the gripped lip portions along the path of travel.

12. The conveyor assembly of claim 11 further comprising a drive for moving the first and second belts to transport the web along the path of travel.

13. The conveyor assembly of claim 11 wherein the web pre-insertion device is a roller.

14. The conveyor assembly of claim 12 wherein the first roller includes a pair of spaced apart annular projections that fit in the recesses of the first pair of endless conveyor belts.

15. The conveyor assembly of claim 14 wherein the annular projections press the first and second lips of the web into the recesses of the first pair of endless conveyor belts.

16. The conveyor assembly of claim 11 wherein the belt insertion device is a roller.

17. The conveyor assembly of claim 11 wherein the web pre-insertion device is a first roller and the belt insertion device is a second roller.

18. The conveyor assembly of claim 17 wherein said first and second lip portions of said web are routed between the first pair of endless conveyor belts and the second pair of endless conveyor belts at a position where the first and second pairs of endless conveyor belts are spaced apart in a vertical direction, then said first and second lip portions of said web are pressed into the recesses of the first pair of endless conveyor belts by the first roller at a position where the second pair of endless conveyor belts are on or above top surfaces of the first pair of endless conveyor belts.

19. The conveyor assembly of claim 17 wherein said first and second lip portions of said web are routed between the first pair of endless conveyor belts and the second pair of endless conveyor belts at a position where the first and second pairs of endless conveyor belts are spaced apart in a vertical direction, then said first and second lip portions of said web are pressed into the recesses of the first pair of endless conveyors belt by the first roller at a position where the first and second pairs of endless conveyor belts are spaced apart in a vertical direction.

20. The conveyor assembly of claim 17 wherein the first roller and the second roller are within three inches of one another along said path of travel.

21. A method of gripping first and second lips of a web material and moving the web material along a path of travel comprising:

pre-inserting first and second lip portions of the web into recesses of a first pair of endless conveyor belts such that one lip portion is disposed in each recess;

pressing a second pair of endless conveyor belts both into contact with the first and second lip portions and into the recesses after said first and second lip portions of the web have been pre-inserted into the recesses, wherein said pre-inserting is upstream of any contact between the second pair of endless conveyor belts and the first and second lip portions;

wherein pressing the second pair of endless conveyor belts into the recesses causes the first and second pairs of belts to grip the first and second lip portions of the web respectively;

moving the first and second endless belts to move the gripped lip portions along the path of travel.

22. The method of claim 21 wherein said first and second lip portions of said web are routed between the first pair of endless conveyor belts and the second pair of endless conveyor belts at a position where the first and second pairs of endless conveyor belts are spaced apart in a vertical direction, then said first and second lip portions of said web are pressed into the recesses of the first pair of endless conveyor belts at a position where the second pair of endless conveyor belts are on or above top surfaces of the first pair of endless conveyor belts.

23. The method of claim 21 wherein said first and second lip portions of said web are routed between the first pair of endless conveyor belts and the second pair of endless conveyor belts at a position where the first and second pairs of endless conveyor belts are spaced apart in a vertical direction, then said first and second lip portions of said web are pressed into the recesses of the first pair of endless conveyor belts at a position where the first and second pairs of endless conveyor belts are spaced apart in a vertical direction.

* * * * *